US012576304B2

(12) United States Patent
DeKnock

(10) Patent No.: US 12,576,304 B2
(45) Date of Patent: Mar. 17, 2026

(54) EXERCISE MACHINES, CRANKSHAFT ASSEMBLIES FOR EXERCISE MACHINES, AND METHODS OF DISASSEMBLING EXERCISE MACHINES HAVING CRANK ARMS

(71) Applicant: Life Fitness, LLC, Franklin Park, IL (US)

(72) Inventor: Byron T. DeKnock, Des Plaines, IL (US)

(73) Assignee: Life Fitness, LLC, Rosemont, IL (US)

( * ) Notice: Subject to any disclaimer, the term of this patent is extended or adjusted under 35 U.S.C. 154(b) by 125 days.

(21) Appl. No.: 18/442,262

(22) Filed: Feb. 15, 2024

(65) Prior Publication Data

US 2024/0293697 A1 Sep. 5, 2024

Related U.S. Application Data

(60) Provisional application No. 63/449,725, filed on Mar. 3, 2023.

(51) Int. Cl.
*A63B 22/06* (2006.01)
*A63B 22/00* (2006.01)

(52) U.S. Cl.
CPC ..... *A63B 22/0605* (2013.01); *A63B 22/0046* (2013.01); *A63B 2022/0611* (2013.01); *A63B 2022/0652* (2013.01)

(58) Field of Classification Search
CPC ..... A63B 22/0605; A63B 2022/0611
See application file for complete search history.

(56) References Cited

U.S. PATENT DOCUMENTS 4,318,310 A 3/1982 Segawa
5,369,863 A * 12/1994 Hasenberg ..... B25B 27/023 29/264

(Continued)

FOREIGN PATENT DOCUMENTS

EP 4424389 A1 * 9/2024 ..... A63B 22/0046

OTHER PUBLICATIONS https://web.archive.org/web/20211127085235/https://www.fastenermart.com/understanding-screw-heads-and-drive-styles.html > (Henceforth Fastener Mart). (Year: 2021).*

(Continued)

*Primary Examiner* — Zachary T Moore
(74) *Attorney, Agent, or Firm* — ANDRUS INTELLECTUAL PROPERTY LAW, LLP

(57) ABSTRACT

An exercise machine has a crankshaft having a crankshaft mounting surface, a landing surface, and a crankshaft bore, a crank arm having a threaded crank arm bore and a crank arm mounting surface that is frictionally engaged with the crankshaft mounting surface, and a fastener that axially extends through the threaded crank arm bore and into engagement with the crankshaft bore to fasten the crank arm to the crankshaft. The threaded crank arm bore is configured for threaded engagement by a removal tool such that removal of the fastener and insertion and rotation of the removal tool in the threaded crank arm bore causes the removal tool to disengage the crank arm mounting surface from the crankshaft mounting surface and thus facilitates removal of the crank arm from the crankshaft. Methods of disassembling an exercise machine having a crank arm are also provided.

20 Claims, 6 Drawing Sheets

(56) References Cited

U.S. PATENT DOCUMENTS

| | | | | |
|---|---|---|---|---|
| 5,718,028 | A * | 2/1998 | Hasenberg | B25B 27/023 29/264 |
| 5,974,644 | A * | 11/1999 | Neinast | B25B 27/02 29/280 |
| 7,811,210 | B1 | 10/2010 | Lundgreen | |
| 8,820,192 | B2 * | 9/2014 | Staples | B29C 70/742 74/594.1 |
| 9,003,922 | B2 * | 4/2015 | Torino | B62M 3/16 74/594.4 |
| 2012/0238410 | A1 | 9/2012 | Magakat | |
| 2021/0387694 | A1 | 12/2021 | Staples | |

OTHER PUBLICATIONS

Office Action issued for EP Application No. 24160129.3, dated May 13, 2025.

Extended European Search Report for EP Application No. 24160129.3, dated Jul. 11, 2024.

Tech Tuesday #44: Crank Puller in Action. Found online via https://www.youtube.com/watch?v=uO_GzqqJTXU. Last accessed May 14, 2025.

* cited by examiner

EXERCISE MACHINES, CRANKSHAFT ASSEMBLIES FOR EXERCISE MACHINES, AND METHODS OF DISASSEMBLING EXERCISE MACHINES HAVING CRANK ARMS

CROSS-REFERENCE TO RELATED APPLICATION

The present application claims the benefit of and priority to U.S. Provisional Patent Application No. 63/449,725, which is incorporated herein by reference in entirety.

FIELD

The present disclosure relates to exercise machines, crankshaft assemblies for exercise machines, and methods of disassembling exercise machines having crank arms.

BACKGROUND

U.S. Pat. No. 7,811,210 is incorporated herein by reference in entirety and discloses a crank assembly for fitness equipment having a ductile spacer engaged between a crankshaft mounting surface and a crank arm mounting surface at the interface thereof and conforming respectively to each to maximize surface contact area to distribute loads across a larger area.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In non-limiting examples, the present disclosure provides an exercise machine comprising a crankshaft having a crankshaft mounting surface, a landing surface, and a crankshaft bore, a crank arm having a threaded crank arm bore and a crank arm mounting surface that is frictionally engaged with the crankshaft mounting surface, and a fastener that axially extends through the threaded crank arm bore and into engagement with the crankshaft bore to fasten the crank arm to the crankshaft. The threaded crank arm bore is configured for threaded engagement with a removal tool such that removal of the fastener and insertion and rotation of the removal tool in the threaded crank arm bore causes the removal tool to disengage the crank arm mounting surface from the crankshaft mounting surface and thus facilitates removal of the crank arm from the crankshaft.

In independent aspects, the exercise machine is configured such that rotation of the removal tool in the threaded crank arm bore causes the removal tool to force the crank arm apart from the landing surface which forces the crank arm mounting surface off of the crankshaft mounting surface.

In independent aspects, the crankshaft bore has a smaller diameter than the threaded crank arm bore.

In independent aspects, the crankshaft bore has threads for engaging the fastener, wherein the threaded crank arm bore has threads for engaging the removal tool, and wherein the threads of the crankshaft bore have a smaller diameter than the threads of the threaded crank arm bore.

In independent aspects, the fastener extends through the threaded crank arm bore without engaging the threaded crank arm bore.

In independent aspects, the fastener has a shaft that extends through the threaded crank arm bore and into threaded engagement with the crankshaft bore. The fastener may have a head that is engaged with an outer surface of the crank arm such that tightening the fastener relative to the crankshaft bore clamps the crank arm mounting surface onto the crankshaft mounting surface. The head may have a tapered lower engagement surface that nests in a recess in the crank arm.

In independent aspects, the landing surface surrounds an outer end of the crankshaft bore and the threaded crank arm bore has a larger diameter than the crankshaft bore such that rotating the removal tool in the threaded crank arm bore moves the removal tool into engagement with the landing surface and such that further rotating the removal tool causes the removal tool to push the crank arm mounting surface off the crankshaft mounting surface.

In independent aspects, the crankshaft mounting surface includes a plurality of surfaces disposed around a perimeter of the crankshaft and crank arm mounting surface includes a corresponding plurality of surfaces for frictionally engaging the plurality of surfaces on the crankshaft mounting surface. The plurality of surfaces may define a cavity that tapers inwardly from an inner side of the crank arm towards an outer side of the crank arm.

In independent aspects, the exercise machine further includes an insert in the crank arm which defines the threaded crank arm bore, wherein the crank arm and the insert are made of different materials.

In independent aspects, the fastener has a threaded shaft having an outside diameter that is less than an inside diameter of the threaded crank arm bore such that the threaded shaft freely passes through the crank arm and into threaded engagement with the crankshaft bore.

In independent aspects, the fastener has a tapered annular lower engagement surface that engages a sloped surface on an outer side of the crank arm such that rotation of the fastener by a tool causes the crank arm mounting surface to frictionally engage the crankshaft mounting surface and causes the tapered head to nest in a recess in the outer side of the crank arm.

The present disclosure also provides non-limiting examples of methods of disassembling exercise machines having a crank arm. The method may include (a) removing the fastener from the crankshaft bore and from the threaded crank arm bore, (b) inserting the removal tool into threaded engagement with the threaded crank arm bore, and (c) rotating the removal tool into the threaded crank arm bore to disengage the crank arm mounting surface from the crankshaft mounting surface. Step (a) may include rotating the fastener relative to the crankshaft bore until the fastener is disengaged from the crankshaft bore. The method may further include (d) removing the crank arm from the crank shaft. The method may include (c) oppositely rotating the removal tool to disengage the removal tool from the threaded crank arm bore.

The present disclosure also provides non-limiting examples of crank assemblies for exercise machines. The crank assembly may comprise a crankshaft having a crankshaft mounting surface, a landing surface, and a crankshaft bore, a crank arm having a threaded crank arm bore and a crank arm mounting surface that is frictionally engaged with the crankshaft mounting surface, a fastener that axially extends through the threaded crank arm bore and into engagement with the crankshaft bore to fasten the crank arm to the crankshaft, and a removal tool having a threaded shaft with a larger diameter than a threaded shaft of the fastener. The threaded crank arm bore is configured for threaded engagement by the removal tool such that removal of the fastener and insertion and rotation of the removal tool in the threaded crank arm bore causes the removal tool to disengage the crank arm mounting surface from the crankshaft mounting surface and thus facilitates removal of the crank arm from the crankshaft. The removal tool may include a second fastener Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

The present inventor has identified problems with conventional exercise machines that incorporate crank arms fastened to crankshafts. Examples of such exercise machines include, but are not limited to, upright or recumbent stationary cycles, elliptical machines, and track, road, and mountain cycles. In particular, the present inventor has recognized that removing the crank arm from the crankshaft can often be difficult. More specifically, it is common for the crank arm to be secured to the crankshaft via a threaded fastener and also frictionally engaged with a tapered square end of the crankshaft. Even after the fastener is removed, the crank arm and the crankshaft often remain in a strong frictional engagement that is not easily overcome by hand. The present disclosure is a result of the inventor's research and development efforts to overcome this problem, in particular to provide improved exercise machines and methods of dissembling exercise machines having crank arms attached to crankshafts.

Figure 1:
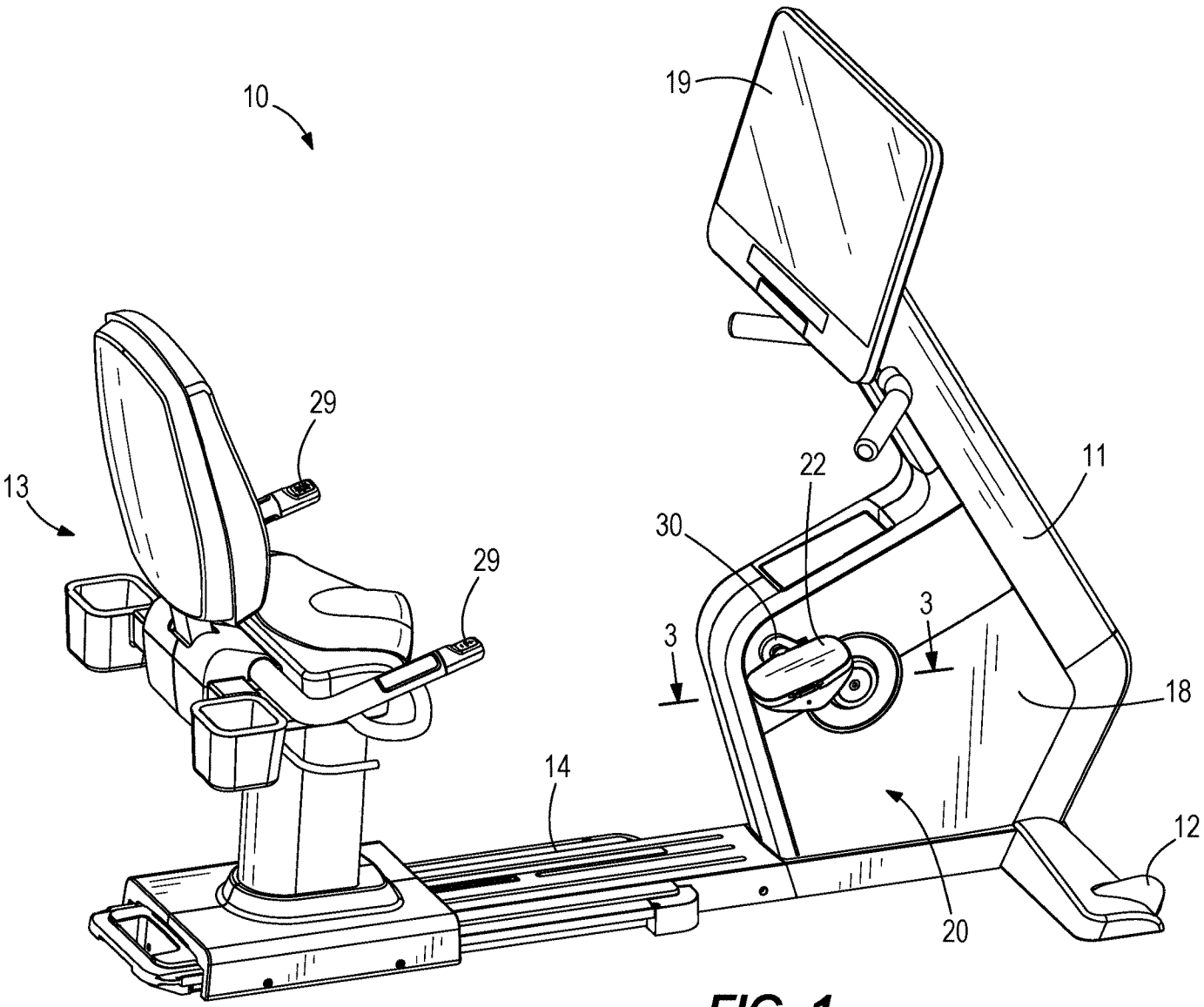
FIG. 1 is an isometric view of an example exercise machine incorporating example crank arms according to the present disclosure.

FIG. 1 depicts an example exercise machine 10 comprising a stationary recumbent cycle that incorporates one or more crank arms 30. The exercise machine 10 has a frame 11 which supports other components of the exercise machine 10 (described hereinbelow) and further supports a user. One or more ground-engaging wheels and/or feet 12 are coupled to the frame 11 and are configured to prevent tipping of the exercise machine 10. In use, the user sits on a seat assembly 13 which is selectively movable along a track 14 coupled to frame 11. The user can move the seat assembly 13 along the track 14 in a first direction towards a crank assembly 20 or in a second direction away from the crank assembly 20. Optionally, the seat assembly 13 may include a locking mechanism (not depicted) for locking the position of the seat assembly 13 relative to the track 14 and the crank assembly 20.

Figure 2:
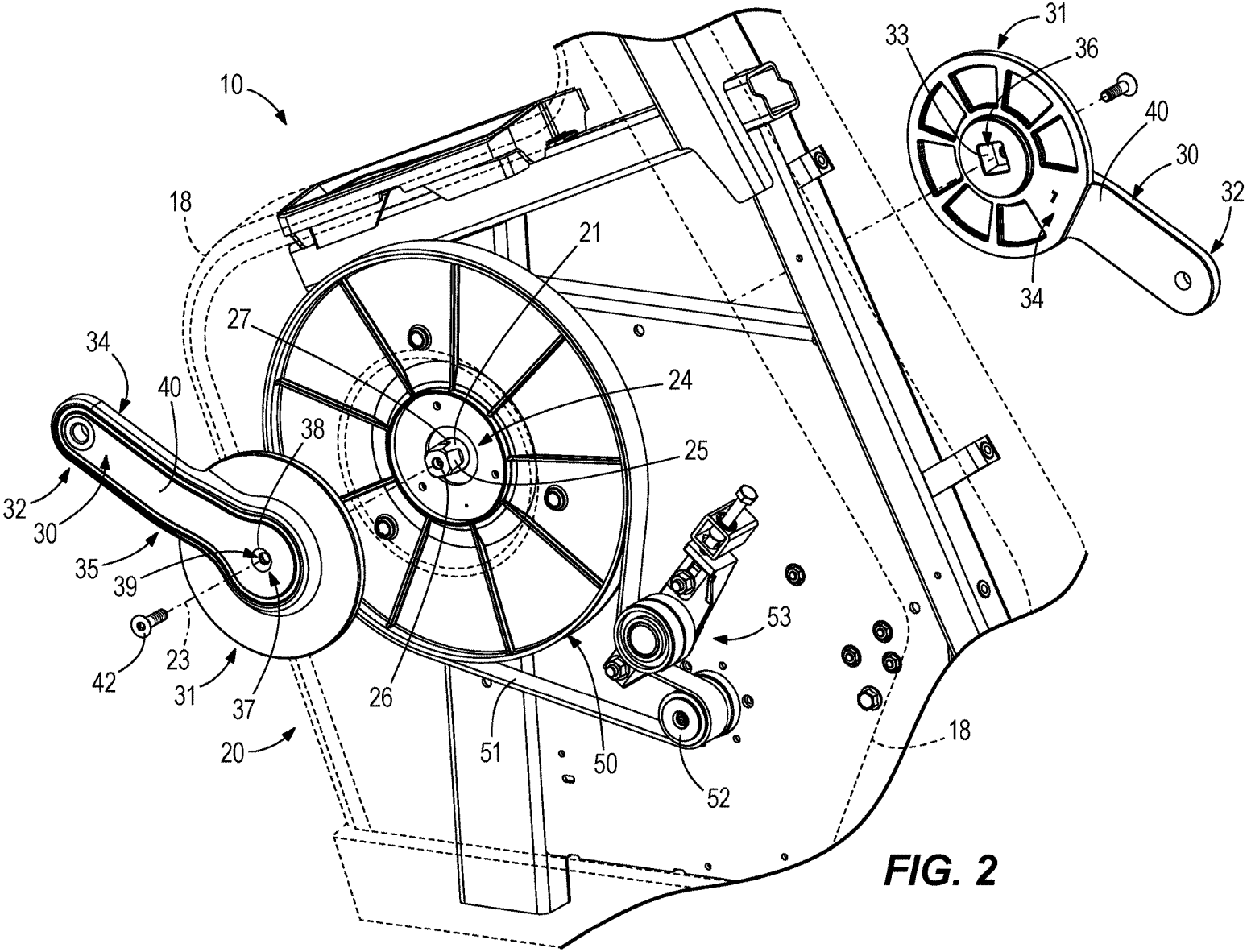
FIG. 2 is an exploded view of crank assembly of the exercise machine of FIG. 1.
Figure 3:
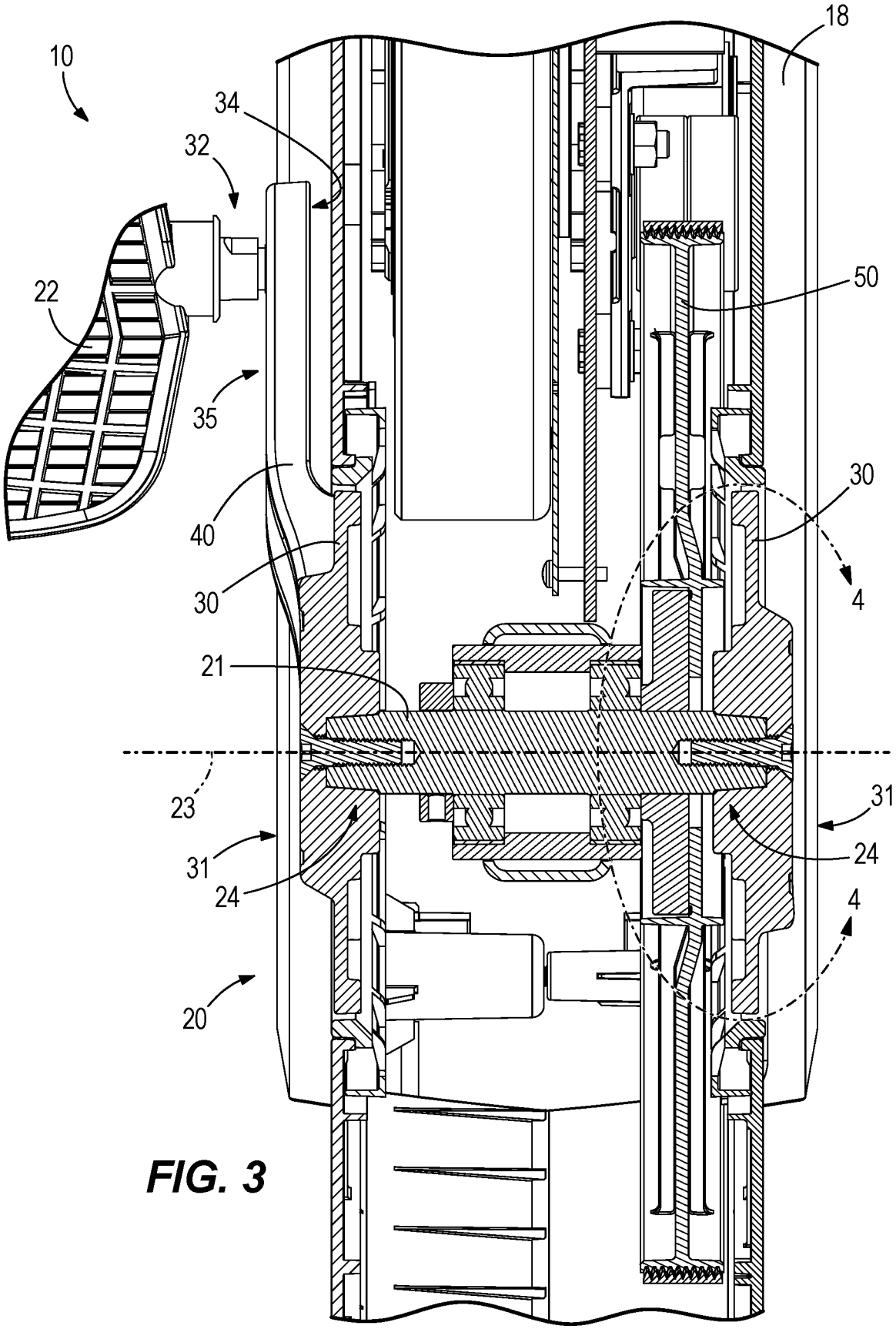
FIG. 3 is a cross-sectional view of the crank assembly of FIG. 1 along line 3-3 on FIG. 1.
Figure 4:
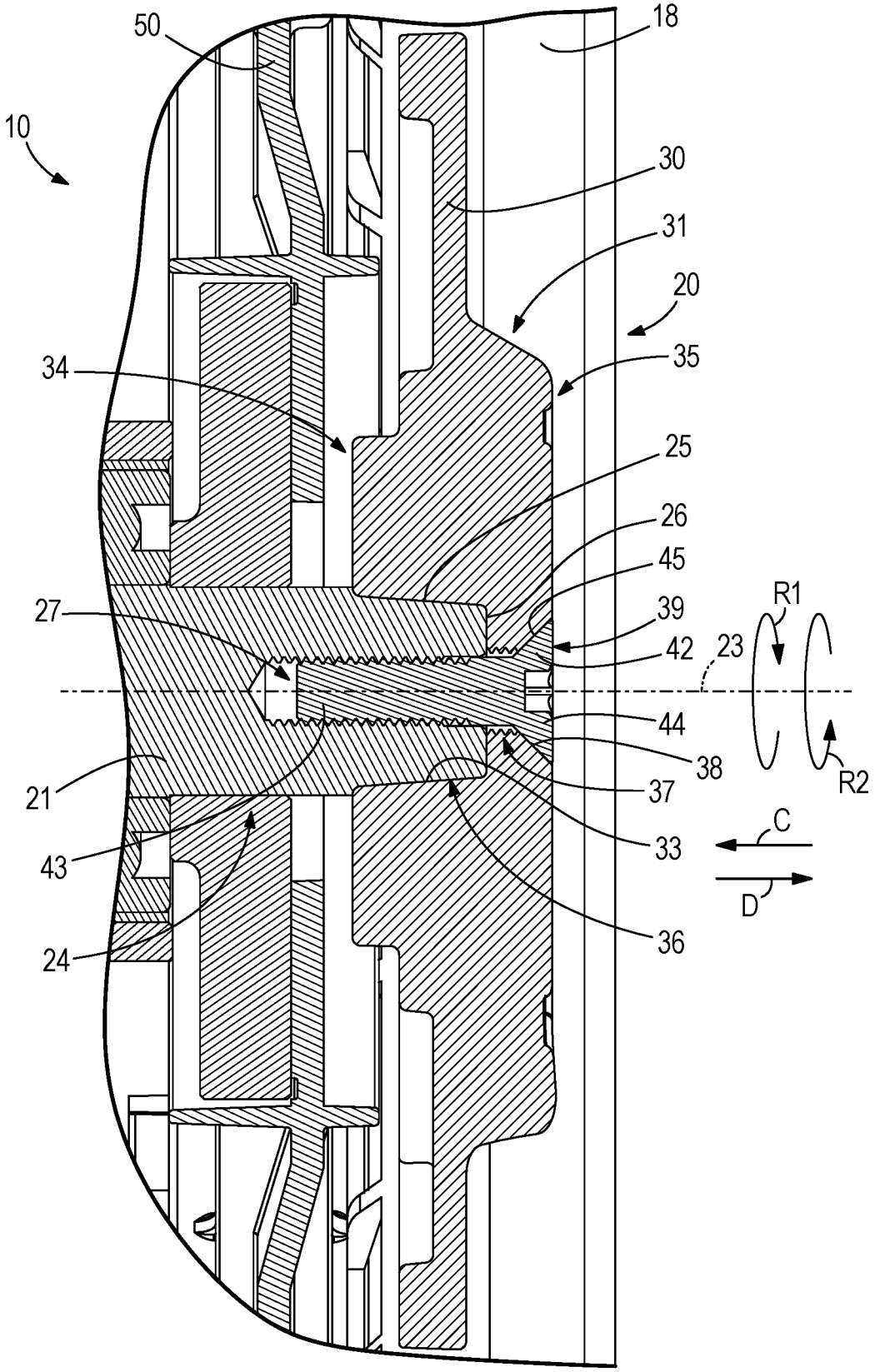
FIG. 4 is an enlarged view of the crank assembly of FIG. 1 within line 4-4 on FIG. 3 with a first fastener coupling a crank arm to a crankshaft.

FIGS. 2-4 depict the example crank assembly 20 in greater detail. The crank assembly 20 is partially covered by a housing 18. Note that FIG. 2 depicts the housing 18 as transparent to thereby expose components of the crank assembly 20 normally concealed by the housing 18. The crank assembly 20 includes one or more crank arms 30 that are coupled to opposing crankshaft ends 24 of a crankshaft 21. The crankshaft 21 extends along an axis 23 between the crankshaft ends 24, and each crankshaft end 24 tapers in a direction towards an axially outer landing surface 26. A crankshaft mounting surface 25 also extends along the outer perimeter of each crankshaft end 24. The crankshaft mounting surface 25 includes one or more planar or curved surfaces such that one or more axially extending edges are between the surfaces along the crankshaft mounting surface 25. In certain non-limiting examples, the crankshaft end 24 has a tapered square or rectangular shape having a cross-sectional shape that reduces in size in an axial direction towards the landing surface 26. Each crankshaft end 24 also includes a threaded crankshaft bore 27 defined therein. The crankshaft bore 27 axially extends along the axis 23 and through the landing surface 26.

A crank arm 30 is coupled to each crankshaft end 24. During use of the exercise machine 10, the user engages the pedals 22 to thereby rotate the crank arms 30 and the crankshaft 21 about the axis 23. Rotation of the crankshaft 21 causes an attached flywheel 50 to rotate about that axis 23. The flywheel 50 drives a belt 51 that turns a pulley 52. Note that the pulley 52 can be coupled to a generator (not depicted) that provides resistance as the user rotates the crankshaft 21 via engagement with the pedals 22. In addition, or alternatively, a resistance device 53, such as an Eddy brake or magnetic or frictional braking device, interacts with the belt 51 to thereby provide resistance. The user can adjust the resistance by entering user inputs via the display panel 19 or an input assembly 29 (see FIG. 1) to thereby vary the resistance applied by the resistance device 53 to the belt 51 and thereby the pedals 22. The display panel 19 may be a touchscreen display or LED display with mechanical and/or tactile push buttons.

A first end 31 of the crank arm 30 is coupled to the crankshaft end 24. The crank arm 30 also includes a second end 32 that is opposite the first end 31. The pedal 22 (FIG. 3) is coupled to the second end 32. A body 40 extends between the first and second ends 31, 32. The first end 31 includes a crank arm mounting surface 33 (FIGS. 2 and 4) that mates with and frictionally engages the crankshaft mounting surface 25 such that the crank arm 30 is frictionally engaged with (secured to) the crankshaft 21. The crank arm mounting surface 33 axially converges or converges in a direction from an inner side 34 of the crank arm 30 towards an opposite outer side 35 of the crank arm 30. As such, the crank arm mounting surface 33 defines a cavity 36 (FIGS. 2 and 4) that tapers in a direction from the inner side 34 towards the outer side 35. The crank arm mounting surface 33 can include one or more planer or curved surfaces such that one or more edges are formed along the crank arm mounting surface 33. In certain non-limiting examples, the cavity 36 has a tapered square or rectangular shape that corresponds to the shape of the crankshaft end 24.

Referring to FIGS. 3-6, the first end 31 of the crank arm 30 also includes a threaded crank arm bore 37 that axially extends through the crank arm 30 and intersects the cavity 36. Threads 41 (see FIG. 5) extend along the entire length of the crank arm bore 37. A diameter E1 (see opposing arrows E1 on FIG. 5) of the threaded crank arm bore 37 is larger than a diameter E2 (FIG. 5) of the threaded crankshaft bore 27. When the crank arm 30 is coupled to the crankshaft end 24, the crank arm bore 37 is concentric with the crankshaft bore 27 and the center of the crank arm bore 37 aligns with the center of the crankshaft bore 27 and the axis 23. The first end 31 of the crank arm 30 also includes a recess 39 in the outer side 35 defined by a sloped surface 38 (described further herein).

A threaded first fastener 42 (see FIGS. 4 and 5) securely couples the crank arm 30 to the crankshaft end 24. The first fastener 42 has a threaded shaft 43 having threads 47 and a tapered head 44. The tapered head 44 has a tapered annular lower engagement surface 45. To secure the crank arm 30 to the crankshaft 21, the threaded shaft 43 is inserted through the crank arm bore 37 such that the threads 47 on the threaded shaft 43 engage with threads 49 of the threaded crankshaft bore 27. Note that the outside diameter D1 (see opposing arrows D1 on FIG. 5) of the threaded shaft 43 is less than the diameter E1 of the crank arm bore 37 such that the threaded shaft 43 freely passes through the crank arm bore 37 towards the threaded crankshaft bore 27 without the threads 47 engaging the threads 41 of the crank arm bore 37. The first fastener 42 is then rotated by a tool such as a screwdriver in a first rotational direction R1 (e.g., clockwise direction) such that the first fastener 42 is moved in a first axial direction (arrow C), further into threaded engagement with the crankshaft bore 27. The tapered annular lower engagement surface 45 engages the sloped surface 38 in the outer side 35 of the crank arm 30 such that further rotation in the first rotational direction R1 causes the crank arm mounting surface 33 to frictionally engage the crankshaft mounting surface 25 and the tapered head 44 is recessed into the recess 39 in the outer side 35 of the crank arm 30 and fastens the crank arm 30 to the crankshaft end 24.

Figure 5:
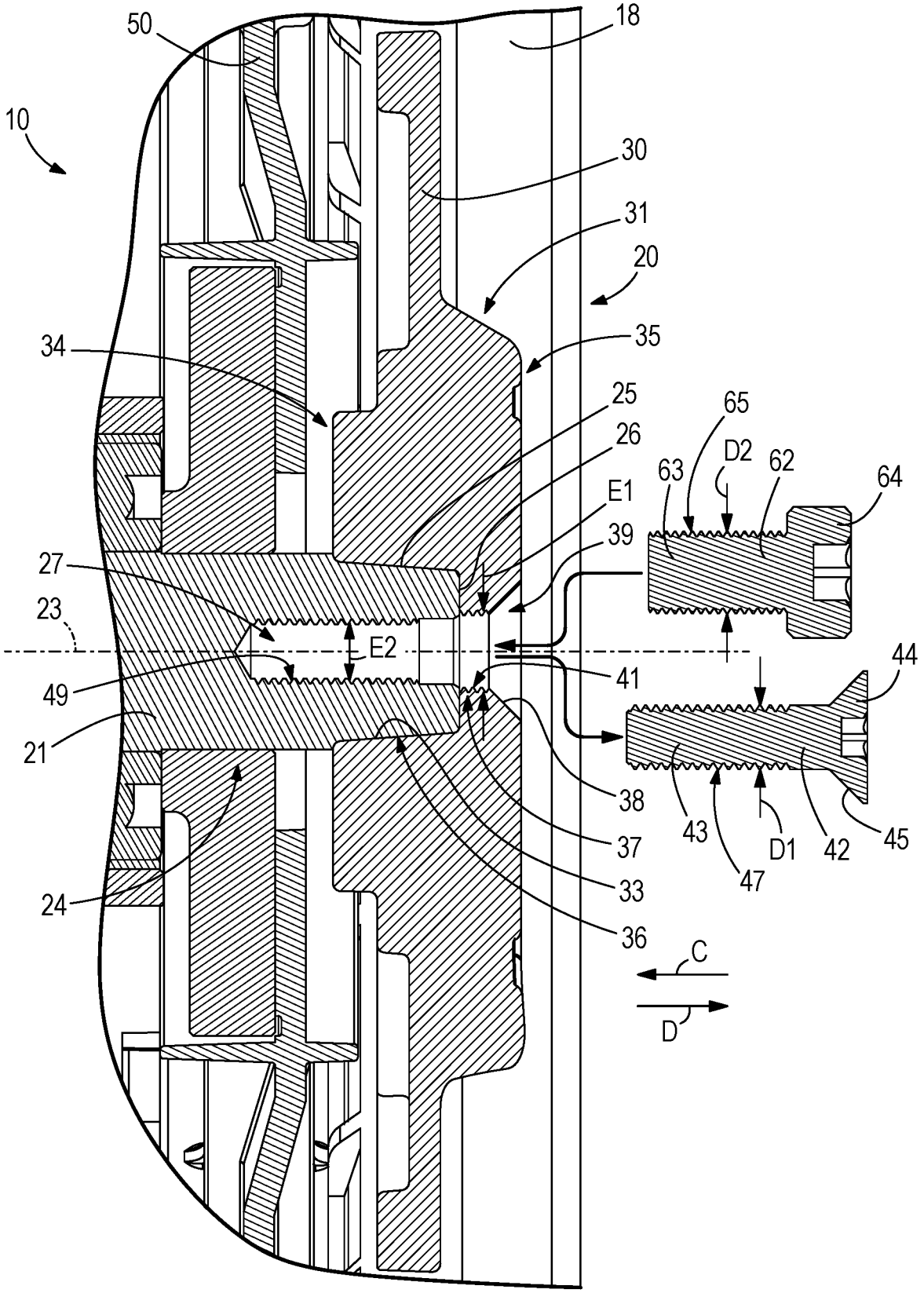
FIG. 5 is a view like FIG. 4 with the first fastener removed and a removal tool such as a second fastener for engagement with the crank arm.

Referring to FIG. 5, to disassemble the crank arm 30 from the crankshaft 21 the first fastener 42 is removed from the crankshaft bore 27 by rotating the first fastener 42 in a second rotational direction R2 (see FIG. 4). Once the first fastener 42 has been removed, the crank arm 30 is still firmly coupled to the crankshaft 21 due to the above-described frictional engagement between the crankshaft mounting surface 25 and the crank arm mounting surface 33. As explained above, this frictional engagement is not normally easily broken by hand.

Figure 6:
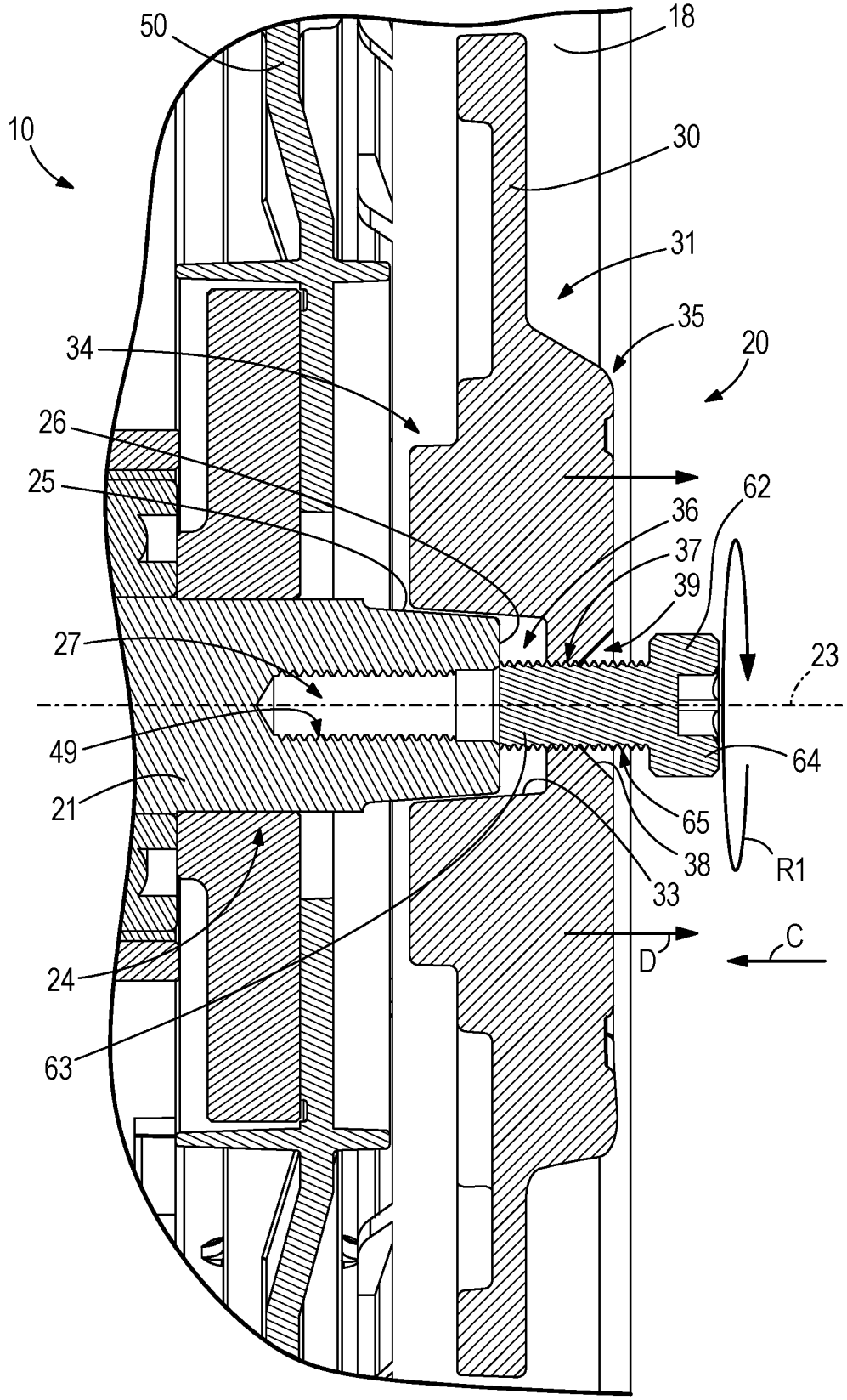
FIG. 6 is a view like FIG. 4 with the second fastener engaging the crank arm such that the crank arm is pushed off the crankshaft.

Referring now to FIGS. 5-6, it is possible to efficiently overcome the noted frictional engagement and disconnect the crank arm 30 from the crankshaft 21 by inserting a threaded removal tool into engagement with the crank arm bore 37. In the illustrated example, the threaded removal tool includes a second fastener 62 having a threaded shaft 63 and a head 64 which is rotatable by a manual or electrically powered screwdriver. Threads 65 extend along the outer diameter of the threaded shaft 63. However, it should be understood that the illustrated example is not limiting. The present disclosure contemplates that instead of the second fastener 62, the removal tool may include a manual or electrically powered screwdriver having the threaded shaft 63 integrated therewith and for example having a hand grip or other means for manually or otherwise rotating the threaded shaft 63.

The removal tool, which in the illustrated example includes the second fastener 62, has an outside diameter D2 (see opposing arrows D2 on FIG. 5) that is larger than the outside diameter D1 of the first fastener 42 (see FIG. 5). The outside diameter D2 of the second fastener 62 is also larger than the outside diameter E2 of the crankshaft bore 27. To remove the crank arm 30 from the crankshaft 21, the threaded shaft 63 is inserted into threaded engagement with the threads 41 of the threaded crank arm bore 37 such that the threads 65 are engaged with the threads 41. Rotation of the second fastener 62 in the first rotational direction R1 (see FIG. 6) causes the second fastener 62 to move in the first axial direction (arrow C) through the threaded crank arm bore 37 such that the end of the threaded shaft 63 makes axial contact with the landing surface 26 of the crankshaft 21 (along axis 23). Further rotation of the second fastener 62 in the first rotational direction R1 will cause the second fastener 62 to move, e.g., push, the crank arm 30 in a second axial direction (arrow D) off the crankshaft 21 due to the engagement between the end of the threaded shaft 63 and the landing surface 26. In this way, the frictional engagement between the crank arm 30 and the crankshaft 21 is broken. Once the crank arm 30 is moved off (e.g., pushed off) the crankshaft 21, the second fastener 62 is rotated in a second rotational direction R2 (e.g., counterclockwise direction) to thereby remove the second fastener from the crank arm bore 37. The second fastener 62 can be utilized to decouple other crank arms 30 from this or other crankshafts.

In the illustrated example, the threaded crank arm bore 37 is provided by the body of the crank arm 30. However in other non-limiting examples, the threaded crank arm bore 37 may be provided by a metal insert (e.g., HELICOIL®) that is fit or screwed into a larger threaded bore of the crank arm 30 to define the inner diameter E1. Thus, the crank arm 30 can include (be composed of) a first material (e.g., aluminum), and the threaded crank arm bore 37 can include (be composed of) a second material (e.g., steel) different from the first material. Thus, the threaded crank arm bore 37 can be stronger and experience less wear over time relative to a threaded bore of the first material.

In non-limiting examples, the threaded crank arm bore 37 is a ring or cylinder with a smooth outer surface and threaded inner surface defining the inner diameter E1 of the threaded crank arm bore 37. Thus, the threaded crank arm bore 37 can be formed by a ring or cylinder that is pressed, coupled, or affixed into a smooth bore of the crank arm 30. Furthermore, the ring or cylinder can also include the second material different from the first material to reduce wear of the threaded crank arm bore 37.

It will thus be understood that the present disclosure provides examples of exercise machines comprising a crankshaft having a crankshaft mounting surface, a landing surface, and a crankshaft bore, a crank arm having a threaded crank arm bore and a crank arm mounting surface that is frictionally engaged with the crankshaft mounting surface, and a fastener that axially extends through the threaded crank arm bore and into engagement with the crankshaft bore to fasten the crank arm to the crankshaft. The threaded crank arm bore is configured for threaded engagement with a removal tool such that removal of the fastener and insertion and rotation of the removal tool in the threaded crank arm bore causes the removal tool to disengage the crank arm mounting surface from the crankshaft mounting surface and thus facilitates removal of the crank arm from the crankshaft.

The crank arm is configured such that rotation of the removal tool in the threaded crank arm bore causes the removal tool to force the crank arm apart from the landing surface which forces the crank arm mounting surface off of the crankshaft mounting surface. The crankshaft bore has a smaller diameter than the threaded crank arm bore. The crankshaft bore has threads for engaging the fastener, and the threaded crank arm bore has threads for engaging the removal tool, wherein the threads of the crankshaft bore have a smaller diameter than the threads of the threaded crank arm bore.

The fastener extends through the threaded crank arm bore without engaging the threaded crank arm bore. The fastener has a shaft that extends through the threaded crank arm bore and into threaded engagement with the crankshaft bore. The fastener has a head that is engaged with an outer surface of the crank arm such that tightening the fastener relative to the crankshaft bore clamps the crank arm mounting surface onto the crankshaft mounting surface. The head has a tapered lower engagement surface that nests in a recess in the crank arm. The landing surface surrounds an outer end of the crankshaft bore. The threaded crank arm bore has a larger diameter than the crankshaft bore such that rotating the removal tool in the threaded crank arm bore moves the removal tool into engagement with the landing surface and such that further rotating the removal tool causes the removal tool to push the crank arm mounting surface off the crankshaft mounting surface.

The crankshaft mounting surface includes a plurality of surfaces disposed around a perimeter of the crankshaft and the crank arm mounting surface includes a corresponding plurality of surfaces for frictionally engaging the plurality of surfaces on the crankshaft mounting surface. The plurality of surfaces defines a cavity that tapers inwardly from an inner side of the crank arm towards an outer side of the crank arm.

In some examples, an insert in the crank arm defines the threaded crank arm bore, wherein the crank arm and the insert are made of different materials.

The fastener may have a threaded shaft having an outside diameter that is less than an inside diameter of the threaded crank arm bore such that the threaded shaft freely passes through the crank arm and into threaded engagement with the crankshaft bore. The fastener has a head with a tapered annular lower engagement surface that engages a sloped surface on an outer side of the crank arm such that rotation of the fastener by a tool causes the crank arm mounting surface to frictionally engage the crankshaft mounting surface and causes the head to nest in a recess in the outer side of the crank arm. The removal tool includes a threaded shaft having a larger diameter than a threaded shaft of the fastener. The removal tool may include a second fastener.

Methods of disassembling the exercise machine may comprise the following steps: (a) removing the fastener from the crankshaft bore and from the threaded crank arm bore, (b) inserting the removal tool into threaded engagement with the threaded crank arm bore, and (c) rotating the removal tool into the threaded crank arm bore to disengage the crank arm mounting surface from the crankshaft mounting surface. Step (a) may include rotating the fastener relative to the crankshaft bore until the fastener is disengaged from the crankshaft bore. Step (d) may include removing the crank arm from the crankshaft. Step (e) may include before or after step (d) oppositely rotating the removal tool to disengage the removal tool from the threaded crank arm bore.

It will thus also be understood that the present disclosure provides examples of crank assemblies for an exercise machine. The crank assembly may comprise a crankshaft having a crankshaft mounting surface, a landing surface, and a crankshaft bore; a crank arm having a threaded crank arm bore and a crank arm mounting surface that is frictionally engaged with the crankshaft mounting surface; a fastener that axially extends through the threaded crank arm bore and into engagement with the crankshaft bore to fasten the crank arm to the crankshaft; and a removal tool having a threaded shaft having a larger diameter than a threaded shaft of the fastener. The threaded crank arm bore is configured for threaded engagement by the removal tool such that removal of the fastener and insertion and rotation of the removal tool in the threaded crank arm bore causes the removal tool to disengage the crank arm mounting surface from the crankshaft mounting surface and thus facilitates removal of the crank arm from the crankshaft.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives, and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An exercise machine comprising:

a frame;

a crankshaft supported by the frame, the crankshaft having a crankshaft mounting surface, a landing surface, and a crankshaft bore;

a crank arm having a threaded crank arm bore and a crank arm mounting surface that is frictionally engaged with the crankshaft mounting surface; and a fastener that axially extends through the threaded crank arm bore and into engagement with the crankshaft bore to fasten the crank arm to the crankshaft, wherein the threaded crank arm bore is configured for threaded engagement with a removal tool such that removal of the fastener and insertion and rotation of the removal tool in the threaded crank arm bore causes the removal tool to disengage the crank arm mounting surface from the crankshaft mounting surface and thus facilitates removal of the crank arm from the crankshaft.

2. The exercise machine according to claim 1, wherein the crank arm is configured such that rotation of the removal tool in the threaded crank arm bore causes the removal tool to force the crank arm apart from the landing surface which forces the crank arm mounting surface off of the crankshaft mounting surface.

3. The exercise machine according to claim 1, wherein the crankshaft bore has a smaller diameter than the threaded crank arm bore.

4. The exercise machine according to claim 1, wherein the crankshaft bore has threads for engaging the fastener, wherein the threaded crank arm bore has threads for engaging the removal tool, and wherein the threads of the crankshaft bore have a smaller diameter than the threads of the threaded crank arm bore.

5. The exercise machine according to claim 1, wherein the fastener extends through the threaded crank arm bore without engaging the threaded crank arm bore.

6. The exercise machine according to claim 1, wherein the fastener has a shaft that extends through the threaded crank arm bore and into threaded engagement with the crankshaft bore.

7. The exercise machine according to claim 6, wherein the fastener has a head that is engaged with an outer surface of the crank arm such that tightening the fastener relative to the crankshaft bore clamps the crank arm mounting surface onto the crankshaft mounting surface.

8. The exercise machine according to claim 7, wherein the head has a tapered lower engagement surface that nests in a recess in the crank arm.

9. The exercise machine according to claim 1, wherein the landing surface surrounds an outer end of the crankshaft bore and wherein the threaded crank arm bore has a larger diameter than the crankshaft bore such that rotating the removal tool in the threaded crank arm bore moves the removal tool into engagement with the landing surface and such that further rotating the removal tool causes the removal tool to push the crank arm mounting surface off the crankshaft mounting surface.

10. The exercise machine according to claim 1, wherein the crankshaft mounting surface includes a plurality of surfaces disposed around a perimeter of the crankshaft, and wherein the crank arm mounting surface includes a corresponding plurality of surfaces for frictionally engaging the plurality of surfaces on the crankshaft mounting surface.

11. The exercise machine according to claim 10, wherein the plurality of surfaces of the crank arm mounting surface defines a cavity that tapers inwardly from an inner side of the crank arm towards an outer side of the crank arm.

12. The exercise machine according to claim 1, further comprising an insert in the crank arm which defines the threaded crank arm bore, wherein the crank arm and the insert are made of different materials.

13. The exercise machine according to claim 1, wherein the fastener has a threaded shaft having an outside diameter that is less than an inside diameter of the threaded crank arm bore such that the threaded shaft extends freely through the crank arm and into threaded engagement with the crankshaft bore.

14. The exercise machine according to claim 1, wherein the fastener has a head with a tapered annular lower engagement surface that engages a sloped surface on an outer side of the crank arm such that rotation of the fastener by a tool causes the crank arm mounting surface to frictionally engage the crankshaft mounting surface and causes the head to nest in a recess in the outer side of the crank arm.

15. A method of disassembling the exercise machine according to claim 1, the method comprising the following steps:

(a) removing the fastener from the crankshaft bore and from the threaded crank arm bore, (b) inserting the removal tool into threaded engagement with the threaded crank arm bore, and (c) rotating the removal tool into the threaded crank arm bore to disengage the crank arm mounting surface from the crankshaft mounting surface.

16. The method according to claim 15, wherein step (a) includes rotating the fastener relative to the crankshaft bore until the fastener is disengaged from the crankshaft bore.

17. The method according to claim 15, further comprising (d) removing the crank arm from the crankshaft.

18. The method according to claim 15, further comprising (e) oppositely rotating the removal tool to disengage the removal tool from the threaded crank arm bore.

19. A crank assembly for an exercise machine, the crank assembly comprising:

a crankshaft having a crankshaft mounting surface, a landing surface, and a crankshaft bore;

a crank arm having a threaded crank arm bore and a crank arm mounting surface that is frictionally engaged with the crankshaft mounting surface;

a fastener that axially extends through the threaded crank arm bore and into engagement with the crankshaft bore to fasten the crank arm to the crankshaft; and a removal tool having a threaded shaft with a larger diameter than a threaded shaft of the fastener, wherein the threaded crank arm bore is configured for threaded engagement by the removal tool such that removal of the fastener and insertion and rotation of the removal tool in the threaded crank arm bore causes the removal tool to disengage the crank arm mounting surface from the crankshaft mounting surface and thus facilitates removal of the crank arm from the crankshaft.

20. The crank assembly according to claim 19, wherein the removal tool includes a second fastener.

* * * * *